US010627162B2

(12) United States Patent
Delaveau

(10) Patent No.: US 10,627,162 B2
(45) Date of Patent: Apr. 21, 2020

(54) FREEZE-DRYING METHOD AND DEVICE

(71) Applicant: Jean Delaveau, Lyons (FR)

(72) Inventor: Jean Delaveau, Lyons (FR)

( * ) Notice: Subject to any disclaimer, the term of this patent is extended or adjusted under 35 U.S.C. 154(b) by 0 days.

(21) Appl. No.: 16/088,874

(22) PCT Filed: Apr. 10, 2017

(86) PCT No.: PCT/FR2017/050848
§ 371 (c)(1),
(2) Date: Sep. 27, 2018

(87) PCT Pub. No.: WO2017/178740
PCT Pub. Date: Oct. 19, 2017

(65) Prior Publication Data

US 2019/0145705 A1 May 16, 2019

(30) Foreign Application Priority Data

Apr. 14, 2016 (FR) ..... 16 53298

(51) Int. Cl.
*F26B 11/04* (2006.01)
*F26B 11/02* (2006.01)

(52) U.S. Cl.
CPC ..... *F26B 11/049* (2013.01); *F26B 11/026* (2013.01); *F26B 11/0445* (2013.01)

(58) Field of Classification Search
CPC .... F26B 11/049; F26B 11/0445; F26B 11/026
See application file for complete search history.

(56) References Cited

U.S. PATENT DOCUMENTS 2,803,888 A 8/1957 Cerletti
4,389,794 A * 6/1983 Bitterly ..... B01J 3/006 34/287

(Continued)

FOREIGN PATENT DOCUMENTS

EP 1236962 9/2002
EP 2578975 4/2013

(Continued)

OTHER PUBLICATIONS

Rapport de Recherche Internationale et de L'Opinion Ecrite [International Search Report and the Written Opinion] dated Jul. 18, 2017 From the L'Administration Chargée de la Recherche Internationale [International Searching Authority] Re. Application No. PCT/FR2017/050848. (15 Pages).

*Primary Examiner* — Jessica Yuen

(57) ABSTRACT

The invention relates to a freeze-drying device comprising: —an evaporation chamber (5) comprising heating means (15, 16), —a condensing chamber (10) communicating with the said evaporation chamber, —the said evaporation chamber (5) and the said condensing chamber (10) being mounted secured to one another about an axle (30) capable of rotating, characterized in that the device further comprises: —a products inlet and outlet (1, 8) which are connected to the said evaporation chamber (5) by flexible connectors, the products inlet and outlet (1, 8) being mounted fixedly with respect to the evaporation chamber, and —a motor (12) driving the said axle (30) on itself with the following back-and-forth movement: —a first movement driving the said axle (30) in a first direction of rotation with an angle of rotation (α1) of between 5° and 90°, and —a second movement driving the said axle (30) in a second direction of rotation, opposite to the first angle of rotation, with an angle of rotation (α2) of between −5° and −90°.

14 Claims, 3 Drawing Sheets

(56) References Cited

U.S. PATENT DOCUMENTS

| | | | | |
|---|---|---|---|---|
| 2002/0121029 | A1* | 9/2002 | Horigane | F26B 3/30 34/284 |
| 2014/0237846 | A1* | 8/2014 | Plitzko | F26B 5/06 34/287 |

FOREIGN PATENT DOCUMENTS

| | | |
|---|---|---|
| EP | 2578976 | 4/2013 |
| WO | WO 82/02246 | 7/1982 |
| WO | WO 2012/018320 | 2/2012 |

* cited by examiner

FREEZE-DRYING METHOD AND DEVICE

RELATED APPLICATIONS

This application is a National Phase of PCT Patent Application No. PCT/FR2017/050848 having International filing date of Apr. 10, 2017, which claims the benefit of priority of French Patent Application Nos. 1653297 and 1653298, both filed on Apr. 14, 2016. The contents of the above applications are all incorporated by reference as if fully set forth herein in their entirety.

FIELD AND BACKGROUND OF THE INVENTION

The invention relates to the field of devices that process products by freeze-drying. More particularly, the invention relates to devices that perform bulk freeze-drying. The invention also relates to a method of bulk freeze-drying.

The invention has a particularly advantageous application in the fields of pharmaceutical preparation and food preparation, and more generally for all high value-added industries that need a preservation method by freeze-drying. For example, the invention can be implemented in the field of biotechnology for the production of inoculum with a view to fermentation of the biomass, in the area of foodstuffs for the freeze-drying of fruits, vegetables, beverages and food preparations, in the area of health for freeze-drying of proteins, peptides, enzymes, bacteria, viruses, living cells, sensitive formulations of antibodies or sensitive molecules, plasma fraction or formulation of sensitive polymers.

Freeze-drying is a low temperature dehydration operation that consists of eliminating by sublimation most of the water contained in a product. Freeze-drying makes it possible to obtain high quality end products without degrading the structure, while preserving a large part of the activity of the microorganisms or cells. Freeze-dried products are able to be preserved for a long time due to the decreased activity of the water in the product.

Indeed, by decreasing the activity of the water in the product, no living organism can grow and all of the chemical reactions that take place in water cannot occur. The very low activity of the water also makes it possible to block any microbiological growth activity. Thus, the form and aspect of freeze-dried products are well preserved and their aromatic qualities are far superior to those of products dried by methods of atomization, fluidized bed or simple drying by evaporators with several effects.

Moreover, the transition of products from the frozen state to the dehydrated state, in the absence of a high proportion of liquid water, reduces the possibilities of development of alteration reactions. Another major technological advantage of freeze-drying is found in the capacity of freeze-dried products to be rehydrated instantaneously thanks to the microscopic pores formed by the vapor during sublimation of the water.

However, the use of freeze-drying is limited by its cost and remains far less used than drying. The low productivity of freeze-drying is due to the discontinuous mode of operation under a vacuum and at very low temperature, which results in significant processing times of between 10 hours and several days. Under these extreme conditions, heat transfers have a very low efficiency. Comparatively, drying is conventionally performed at atmospheric pressure at moderate temperatures, generally between 50 and 100° C., and a heat transfer with better efficiency. Thus, the investment and operating expenses of freeze-drying devices are high. For example, the energy consumption of a freeze-drying device is typically on the order of 2500 to 6000 kWh per ton of water to eliminate.

Consequently, freeze-drying is only applied for products having a high added value. In food industries, coffee can be mentioned, as well as herbs and spices, cooked dishes, or ingredients sensitive to dehydration from heat (vegetables, fruits, seafoods, etc.). Drying methods based on atomization or fluidized bed are currently used for instant dehydrated soups, culinary preparations and breakfast cereals because they are much less expensive. The pharmaceutical industries (vaccines, serum, drugs) and bio-industries (leavens) have a much greater interest in the freeze-drying method, which alone enables them to obtain the most characteristic property of the technique, namely the preservation of an active ingredient (biological and/or drug activity) in a product that will be stored at a temperature close to ambient temperature.

Freeze-drying requires the use of a device composed of a freezing chamber connected to cooling means, an evaporation chamber connected to heating means and a condensing chamber connected to the evaporation chamber. The condensing chamber is configured to collect the water vapor produced from the evaporation chamber onto an ice trap. In the field of pharmacy, for reasons of sterility, the evaporation chamber also freezes the products prior to evaporation. On the contrary, in the field of food, the freezing is conventionally performed in an independent apparatus, so that the freeze-drying device itself only includes an evaporation chamber as well as a condensing chamber.

Cooling means are provided in the condensing chamber to freeze the water vapor coming from the evaporation chamber. The water in vapor form is then transformed into ice in the condensing chamber and the ice is stored in the condensing chamber on the ice trap. In some cases, the freezing and sublimation can be performed within the same enclosure. In this scenario, the freezing chamber and the evaporation chamber consist of a single chamber connected to the cooling means and to the heating means. Preferably, the chambers are also placed under vacuum by a vacuum pump so as to pass below the triple point of water and enable the water to change over from the solid phase to the gas phase.

The freeze-drying method has a first step consisting of freezing the products in the freezing and evaporation chamber to enable their drying at low temperature. Rapid freezing is desired so as to form small ice crystals. Freezing that is too slow results in favoring the formation of large crystals likely to damage the structure of the product by tearing the walls of its cells, for example for yeasts, viruses, and animal or vegetable cells. A second step consists of creating a vacuum in the evaporation chamber, the low pressure, generally well below 6.1 hPa, so the water in the form of ice can transform into vapor without thawing the products. The products receive a supply of heat to furnish the energy needed for the latent heat for sublimation of the ice into vapor. The vapor enters the condensing chamber, which is conditioned to transform the water vapor into ice through use of an ice trap maintained at very low temperature, generally −60° C.

This freeze-drying method therefore makes it possible to extract up to 95% of the water contained in the products. Freeze-drying can make it possible to lower the moisture content of the product to an extremely low level, between 1% and 10% of the volumetric weight of the product, and to prevent bacteria and mold from proliferating and enzymes from triggering chemical reactions likely to breakdown the product. Thus, freeze-dried products are preserved for a very long time. When hermetically packed, protected from humidity, light and oxygen, freeze-dried products can be preserved at ambient temperature for many years. Furthermore, high quality sterilized products also require sterilization of the sterilization chain.

However, the freeze-drying process has a number of disadvantages related to the required major inputs of heat and cooling, to placing the evaporation and condensing chambers under a vacuum, and the need to ensure sterilization of these chambers. The necessary inputs of heat and cooling require the use of highly efficient elements, functioning for example with liquid nitrogen. Placing the chambers under a vacuum and the needs for sterilization require the use of a sealed enclosure and a vacuum pump. Moreover, during sublimation there is a risk of clumping of products that deteriorates the quality of the freeze-dried products.

In addition, the freeze-drying time depends on the size of the particles of the products to be freeze-dried and on the surface area of the products coming into contact with the heat source. A conventional solution consists of distributing the products to be freeze-dried into small vials. The heat source is configured to heat the base of the vials so as to transmit the heat to all of the products stored in the vials by conduction and radiation. After freeze-drying, the product appears in the form of a porous cake in the shape of the vial. The average time for freeze-drying is therefore between two and three days due to the migration time of the heat by conduction and radiation in the vials. However, the distribution of the products to be freeze-dried in a large number of vials requires an evaporation chamber of very large size. Consequently, the power of the heating means, cooling means and vacuum creating means must be increased.

International patent application No. 2012/018320 proposes to reduce the freeze-drying time by implementing bulk freeze-drying by increasing the contact surface between the products and the heat source. More specifically, this patent application discloses a cyclone chamber having a propeller configured to drive the products in a cyclonic motion during freeze-drying. Although this device makes it possible to freeze dry products in bulk, it is particularly complex to implement under a vacuum.

With bulk freeze-drying, an average freeze-drying time of between 5 and 50 hours can be achieved. The reduction of freeze-drying time makes it possible to reduce consumption, production time and therefore production costs. Moreover, limiting the freeze-drying time reduces the exposure of the product to heat. This allows the quality of the freeze-dried product to be improved.

The documents WO 82/02246 and EP 1,236,962 describe freeze-drying chambers the evaporation chamber whereof is rotatable. However, these devices require a complete stoppage of the evaporation chamber in order to add and extract the products. Indeed, the evaporation chamber in these documents is placed under a vacuum during the freeze-drying, and adding and extracting products requires the return to atmospheric pressure and the opening of a sealed wall. Thus, the means for adding and extracting products are particularly long and complex.

The documents EP 2,578,975 and EP 2,578,976 also propose reducing the freeze-drying time by implementing a bulk freeze-drying. To do this, the evaporation chamber is mounted on an axle rotated during freeze-drying. The evaporation chamber is mounted in a sterile enclosure and the axle of the chamber extends from the enclosure through an opening in order to be driven by a motor. A seal is placed around the axle at the opening of the enclosure in order to guarantee the vacuum of the enclosure without loss of pressure at the opening. The seal is configured to withstand pressures of 2.5 bars at temperatures varying between −60 and 120° C.

To carry out the freeze-drying, an operator connects a sterile inlet to the evaporation chamber, passing through the sterile enclosure so as to reach the receptacle. The products to be freeze-dried are then disposed in the receptacle by passing through the sterile inlet and the sterile enclosure. The operator then disconnects the inlet, taking care to preserve the sterility in the enclosure. Freeze-drying is then carried out while the motor rotates the receptacle so as to agitate the products to prevent clumping thereof. The evaporation and condensing chambers are in communication but do not turn. When the freeze-drying is completed, the operator connects a sterile outlet to the evaporation chamber by the sterile enclosure so as to extract the freeze-dried products from the receptacle.

Due to the pressures utilized and the difference of temperatures, the seal around the axle quickly degrades, which can cause a loss of seal or sterility. Furthermore, this freeze-drying device also requires very precise handling by the operator in order to ensure the sterility of the products.

Moreover, the freeze-drying devices require steps of handling by an operator between two freeze-dryings. The result is that the freeze-drying is a process that is mostly not automated, thus increasing production time and therefore the cost of freeze dried products.

The problem of the invention therefore consists of developing a device for freeze-drying products in bulk that responds to the disadvantages of the devices of the prior art.

SUMMARY OF THE INVENTION

The present invention seeks to resolve this problem by mounting the inlet and the outlet of the evaporation chamber on flexible connectors and by agitating the evaporation and condensing chambers according to a back-and-forth movement. Consequently the inlet and outlet are permanently connected to the evaporation chamber and it is no longer necessary to mount both chambers in a sterile enclosure. Furthermore, the back-and-forth movement makes it possible to use heat transfer fluids in double walls around the evaporation and condensing chambers by connecting the inlets and outlets of said fluids using flexible connectors. Thus, the heating and cooling can be achieved by conduction at the support surface of the products in the evaporation chamber and by radiation over the remainder of the surface of the evaporation chamber.

Comparatively, in the documents EP 2,578,975 and EP 2,578,976, the heat transfers can only be achieved by radiation around evaporation and condensing chambers. The heat transfers by conduction allowed by the invention improve the precision of heat transfers and reduces consumption.

To this effect, according to a first aspect, the invention relates to a freeze-drying device comprising:

- an evaporation chamber comprising means of heating the evaporation chamber that are configured to sublimate the water contained in the frozen products intended to be placed in the evaporation chamber,
- a condensing chamber communicating with the evaporation chamber, and comprising means of cooling the condensing chamber that are configured to transform the vapor coming from the evaporation chamber into ice, the evaporation chamber and the condensing chamber being mounted secured to one another about a rotatable axle.

The invention is characterized in that the device further comprises:

a products inlet and/or outlet connected to the evaporation chamber by flexible connectors, the products inlet and outlet being mounted fixedly with respect to the evaporation chamber, a motor driving said axle about itself with the following back-and-forth movement:

a first movement driving said axle in a first direction of rotation with an angle of rotation less than 180°; and a second movement driving said axle in a second direction, opposite to the first direction of rotation, with an angle of rotation less than −180°.

The products inlet and outlet are fixedly connected to the evaporation chamber. Therefore, it is no longer necessary to mount the evaporation and condensing chambers in a sterile enclosure, and there is no longer the problem of sealing the sterile enclosure. The elimination of the enclosure limits the overall size of the device and the power needed for the heating, cooling and vacuum means. The result is that the energy consumption of the freeze-drying device is 20 to 40% lower than devices of the prior art for the same quantity of products.

This device makes it possible to carry out discontinuous freeze-drying.

According to another characteristic, the invention relates to a freeze-drying method implemented by the device previously described, comprising the steps of:

filling the evaporation chamber with products, frozen or not, by opening the product inlet, when the products are not frozen, cooling the evaporation chamber by the cooling means until the products are frozen, once the products are frozen, placing the evaporation chamber and the condensing chamber under vacuum, heating the evaporation chamber by heating means until obtaining sublimation of the water from the products contained in the evaporation chamber, cooling the condensing chamber by cooling means so as to trap the vapor entering into the condensing chamber, agitation of the evaporation chamber by rotation of the axle about itself in two repeated complementary movements throughout the sublimation time:

a first movement rotating said axle about itself in a first direction of rotation with an angle of rotation less than 180°; and a second movement rotating said axle about itself in a second direction, opposite to the first direction of rotation, with an angle of rotation less than 180°, and extraction of the products from the evaporation chamber.

Preferably, an operator monitors these production steps by means of temperature sensors disposed in the evaporation chamber and in the condensing chamber.

As a variant, the freeze-drying can be performed continuously by compartments arranged in the evaporation chamber. A third large-amplitude movement of rotation of the axle allows the products to be freeze-dried to be transferred between the compartments of the evaporation chamber so as to create a freeze-drying path inside the evaporation chamber.

This embodiment differs from the device previously described in that it further comprises:

compartments formed in the evaporation chamber by partitions extending over only one portion of the height of the evaporation chamber, and in that the motor drives the axle about itself according to at least three complementary movements:

a first movement driving the axle in a first direction of rotation with an angle of rotation between 5° and 90°;

a second movement driving the axle in a second direction of rotation, opposite to the first angle of rotation, with an angle of rotation between −5° and −90°; and a third movement driving the axle with an angle of rotation between 90° and 180°, said third movement being coupled to an inclined positioning of the evaporation chamber so as to displace the products by gravity between two consecutive departments of said evaporation chamber.

In this variant, the invention makes it possible to perform freeze-drying continuously, i.e. products can be added regularly over time without the need to completely stop the freeze-drying process. Thus, products can be added through the inlet in the first compartment of the evaporation chamber while other products disposed in the evaporation chamber and in other compartments are still in the process of freeze-drying. In the same way, freeze-dried products can be extracted from the evaporation chamber while other products are still in the process of freeze-drying.

According to one embodiment, the inlet includes a loading chamber partitioned by two locks and the outlet includes an unloading chamber partitioned by two locks. This embodiment makes it possible to guarantee the seal and sterility of adding and extracting the products in the evaporation chamber while respecting the vacuum of the incoming products or the atmospheric pressure of the outgoing products.

According to one embodiment, the opening of the lock separating the inlet from the evaporation chamber and the opening of the lock separating the outlet from the evaporation chamber are synchronized with the third movement of said motor. This embodiment allows the freeze-drying cycle not to be interrupted when adding or extracting products to or from the evaporation chamber.

According to one embodiment, the device includes two condensing chambers connected to the evaporation chamber by two different airlocks, the first condensing chamber being connected to the evaporation chamber by opening the first airlock and closing the second airlock so as to utilize the first condensing chamber to trap the vapor coming from the evaporation chamber, the second condensing chamber then being regenerated during use of the first condensing chamber and vice versa.

This embodiment makes it possible to empty the ice trapped in one or the other of the condensing chambers without interrupting the continuous freeze-drying process.

According to one embodiment, the device comprises two vacuum pumps, a first vacuum pump connected to the first condensing chamber and a second vacuum pump connected to the second condensing chamber. This embodiment makes it possible to guarantee the evacuation of the condensing chambers when they are connected to the evaporation chamber as well as the negative pressure of said chambers when they are in a regeneration phase.

According to one embodiment, the evaporation chamber is inclined between the inlet [and] the outlet. This embodiment allows the products disposed in one compartment to be guided towards the next compartment in the direction of the outlet. As a variant, the axle can be inclined only during the large amplitude movement intended to transfer the product between two compartments.

According to one embodiment, the partitions of the evaporation chamber have two different shapes mounted alternately in the evaporation chamber, the two shapes having axially offset openings intended for the passage between two compartments of the product to be freeze-dried. The axial offset of two consecutive partitions makes it possible to limit the risk of displacement of the product between several compartments during the large amplitude movement intended to transfer the product between two compartments.

According to one embodiment, the motor is configured to drive the axle in a fourth movement complementary with the three movements, the fourth movement rotating the axle about itself in a direction opposite to the direction of the third movement with an angle of rotation between 90° and 180° so as to move the products between two consecutive compartments of the evaporation chamber. This embodiment also makes it possible to improve the transfer of the product between two consecutive compartments.

The invention also relates to a freeze-drying method implemented by the device previously described, the method comprising the steps of:

- filling the evaporation chamber with products, frozen or not, by opening the product inlet,
- when the products are not frozen, cooling the evaporation chamber by the cooling means until the products are frozen,
- once the products are frozen, placing the evaporation chamber and the condensing chamber under vacuum,
- heating the evaporation chamber by heating means until achieving sublimation of the water from the products contained in the evaporation chamber compartments,
- cooling the condensing chamber by cooling means so as to solidify the vapor entering into the condensing chamber,
- agitation of the evaporation chamber by rotation of the axle about itself in two repeated complementary movements throughout the length of stay in each compartment;
  - a first movement driving the axle in a first direction of rotation with an angle of rotation between 5° and 90°;
  - a second movement driving the axle in a second direction, opposite to the first direction of rotation, with an angle of rotation between 5° and 90°;
  - displacement of the products between two consecutive compartments by displacement of the axle according to a third movement with an angle of rotation between 90° and 180°, said third movement being coupled to an inclined positioning of the evaporation chamber (5), and
- extraction of the products from the evaporation chamber.

Preferably, an operator monitors these production steps by means of temperature sensors disposed in the evaporation chamber and in the condensing chamber.

Whether the implemented device is adapted for continuous or discontinuous freeze-drying, it can further have the following characteristics.

According to one embodiment, the evaporation chamber is disposed laterally relative to the condensing chamber(s). Advantageously, a vapor sensor can be disposed between the evaporation chamber and the condensing chamber, for example by a propeller driven by the vapor flow between the evaporation chamber and the condensing chamber during sublimation. In practice, the evaporation and condensing chambers are in the form of a receptacle that has a generally cylindrical shape. Advantageously, the evaporation chamber has a capacity between 0.01 and 1 $m^3$ up to 10 $m^3$.

According to a particular embodiment, products already frozen are added to the evaporation chamber. In this case, the product inlet is configured to add frozen products. This embodiment enables the freezing step to be separated from the evaporation step. Freezing is thus achieved independently and the frozen products are preferably presented in the form of frozen pellets, granules or particles.

According to another embodiment, the device also includes means for cooling the evaporation chamber. This embodiment makes it possible to use the evaporation chamber for freezing products with the sublimation step. Thus, the products can be added to the evaporation chamber at ambient temperature and a first step consists of freezing the products directly in the evaporation chamber before performing sublimation. Moreover, the back-and-forth movement of the evaporation chamber can be implemented during freezing.

To heat the evaporation chamber, said chamber includes an external double wall, the heating means being configured to circulate a heat transfer fluid in a space formed between the two walls of the evaporation chamber. This embodiment limits the overall size of the device and the consumption of the heating means.

According to one embodiment, the means of cooling the condensing chamber and the means of heating the evaporation chamber are connected to their respective chambers by flexible connectors. This embodiment makes it possible to separate the energy production devices away from the movable structure formed by the two chambers. Consequently, the heating and cooling can be achieved at the same time by conduction at the wall of the chamber with which the surface of the products is in contact and by radiation. This improves the accuracy of heat transfers and reduces consumption.

According to one embodiment, the flexible connectors have a plurality of stainless steel coils. This embodiment makes it possible to avoid the strain-hardening of the metal forming the flexible connectors. As a variant, the connectors can be produced from a plastic material or a material treated to avoid strain-hardening.

According to one embodiment, the evaporation chamber includes baffles disposed inside the evaporation chamber so as to favor the mixing of the products during movements of the evaporation chamber. Thus the baffles ensure a mixing of the products during freeze-drying.

According to one embodiment, the device also includes a first temperature sensor and a pressure sensor disposed in the evaporation chamber and a second temperature sensor disposed in the condensing chamber. This embodiment makes it possible to monitor the temperatures and pressure in order to evaluate the progress of the freeze-drying process.

BRIEF DESCRIPTION OF THE SEVERAL VIEWS OF THE DRAWINGS

The way to implement the invention as well as the advantages deriving therefrom will be clearly seen from the description of the following embodiment, supported by the appended figures in which.

DETAILED DESCRIPTION OF SPECIFIC EMBODIMENTS OF THE INVENTION

Figure 1:
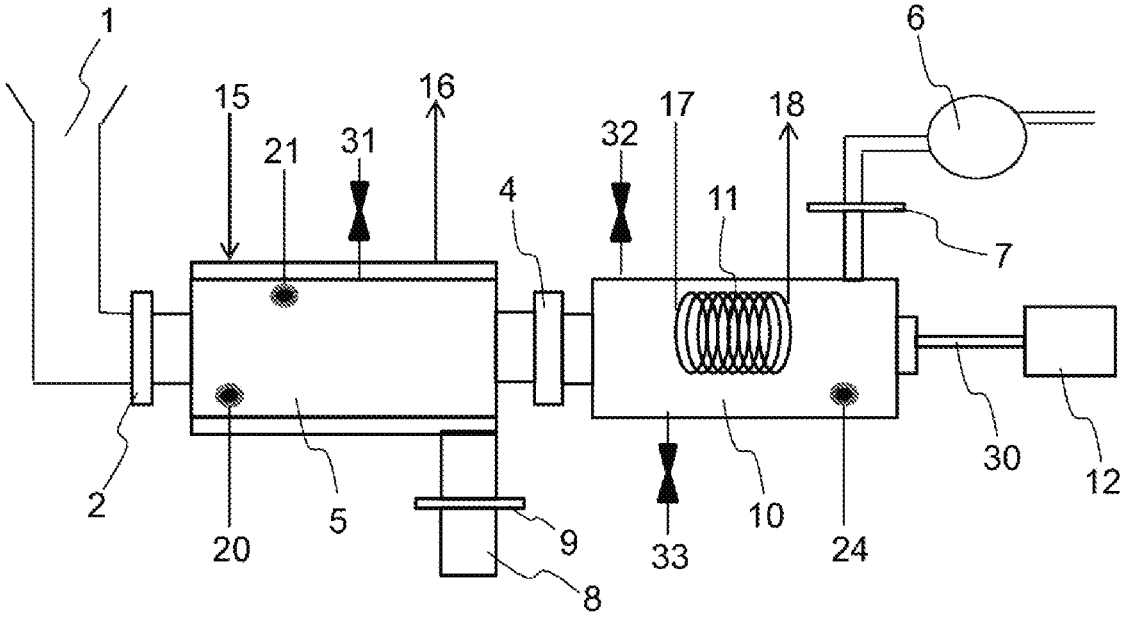
FIG. 1 is a schematic structural representation of a freeze-drying device according to a first embodiment of the invention.

FIG. 1 illustrates a freeze-drying device comprising an evaporation chamber 5 and a condensing chamber 10. An inlet 1 in the form of a hopper is connected to the evaporation chamber 5 by means of a flexible connector. The hopper is further equipped with a first lock 2 so as to add products to be freeze-dried when the lock 2 is open. An outlet 8 in the form of a hopper is also connected to the evaporation chamber 5 by means of a flexible connector. The hopper is further equipped with a second lock 9 so as to extract freeze-dried products when the lock 9 is opened. The locks 2 and 9 also make it possible to guarantee the seal and sterility of the chambers 5, 10. For example, locks 2, 9 of the Agilent Technologies or Gericke brands can be used. As a variant, the invention can be implemented with a single inlet/outlet performing both functions of adding and extracting products.

The evaporation chamber 5 and the condensing chamber 10 are disposed in the extension of one another and independent of each other, i.e. the two chambers form two axially offset spaces. As a variant, the condensing chamber 10 can be disposed around the evaporation chamber 5, so that the two chambers are concentric in this case.

The evaporation chamber 5 has a double outer wall in which a heat transfer fluid circulates to heat the evaporation chamber 5. Preferably, the internal surface of the evaporation chamber 5 has a mirror-finished so as to favor the sliding of the load as well as to minimize the angle of slope.

The heat transfer fluid is heated by an external device connected to the double wall by a fluid inlet 15 and a fluid outlet 16. A steam inlet 31 is also connected to the evaporation chamber 5 in order to sterilize the evaporation chamber 5.

Said heating means 15, 16 make it possible to sublimate frozen products disposed in the evaporation chamber. As a variant, the heat transfer fluid can be heated by a heat exchanger coupled to an external heat source.

The products can be added in frozen form through the inlet 1. As a variant, the products can be frozen directly in the evaporation chamber 5. In this embodiment, the products are added at ambient temperature and the heat transfer fluid circulating in the outer double wall is cooled to a very low temperature, for example on the order of −60° C., so as to produce the freezing of the products prior to the evaporation step. Freezing can also be done in the inlet 1. For example, the freezing can be achieved directly in pellets by means of a gravity drip falling in a nitrogen stream.

The condensing chamber 10 is connected to the evaporation chamber 5 via an airlock 4. The airlock 4 is configured to allow the vapor to pass between the evaporation chamber 5 and the condensing chamber 10. Furthermore, the airlock 4 can include a screen or filter allowing the vapor to pass while retaining the particles of product that could be carried along by the water vapor. Preferably, the filter is made of Gore-Tex®, registered trademark.

The condensing chamber 10 includes an ice trap 11 with the shape of a coiled tube in which a heat transfer fluid circulates, for example liquid nitrogen. The heat transfer fluid is produced by an external device and flows into the tube through an inlet 17 to an outlet 18. As a variant, the heat transfer fluid can be cooled by a heat exchanger coupled to an external source of cold.

The cooling means 17, 18 are implemented when the airlock 4 is open and the vapor penetrates into the condensing chamber. The vapor than freezes on the tube of the ice trap 11. The number of coils and the cross-section of the tube forming the ice trap 11 are determined as a function of the quantity of vapor to be recovered.

A steam intake 32 is also connected to the condensing chamber 10 in order to sterilize the condensing 10 and evaporation chambers prior to starting the freeze-drying process per se. To do this, in a step prior to freeze-drying, the airlock 4 is opened and the steam is added to the two chambers 5, 10.

During the process itself, the steam injected by the steam injection nozzle 32 causes the melting of the ice on the ice trap 11. A drain 33 extracts the vapor injected for evaporating the ice contained in the condensing chamber 10 as well as the steam generated for the sterilization.

The condensing chamber 10 is also connected to a vacuum pump 6 by means of a pipe fitted with a valve 7 Said vacuum pump 6 is configured to evacuate the condensing chamber 10 and the evaporation chamber 5 when the airlock 4 is opened. When the vacuum is created in said two chambers, the valve 7 is kept open and the vacuum is preserved by the condensation of the vapor onto the ice trap 11.

The inlet 1 and the outlet 8 of the inlet and outlet hoppers are connected to the evaporation chamber 5 by sterile flexible sleeves. Advantageously, the heating and cooling means of the two chambers 5, 10 as well as of the vacuum pump 6 are also connected to the respective chambers by flexible connectors. Preferably, the flexible connectors are produced from stainless steel in order to fulfill the sterility requirements. Advantageously the flexible connectors have coils so as to limit the strain-hardening of the stainless steel. As a variant, other materials can be used without changing the invention.

The function of the flexible connectors is to connect a fixed external element, in this case the supply and discharge hoppers, to the chambers 5, 10 so as to ensure a connection of said elements with the chambers 5, 10 when said chambers are rotated about themselves by the motor 12. The flexural capacity of said connectors thus makes it possible to absorb the displacements of the chambers 5, 10 relative to the external elements. The length of the connectors is also chosen to ensure that the connection is maintained during rotation of the chambers 5, 10. For example, Stäubli® brand flexible connectors can be used.

The two chambers 5, 10 are fixedly mounted on an axle 30. Preferably, the two chambers are cylindrical and the axle 30 passes through the center of the two flat faces of the cylinders so as to distribute the mass of the chambers 5, 10 uniformly around the axle 30. In FIG. 1, the axle 30 is connected and secured to the end of the condensing chamber 10, opposite to the end connected to the evaporation chamber 5.

As a variant, the axle 30 can be connected and secured to the evaporation chamber 5. Furthermore, the axle 30 can be held, freely rotatable, by supports. The axle 30 is rotated by a motor 12

Figure 2A:
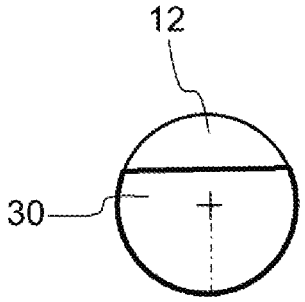
FIGS. 2*a*, 2*b* and 2*c* are sectional views of the position of a partition relative to the evaporation chamber in four different positions of the freeze-drying device of FIG. 1.
Figure 2B:
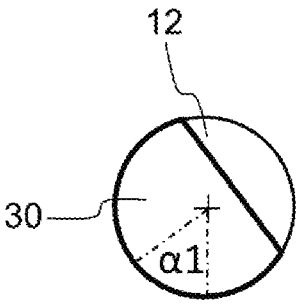

According to the invention, two opposite rotational movements relative to their central axis are induced by the axle 30 driven by the motor 12 and are limited in amplitude so as to create a back-and-forth movement. FIG. 2 illustrates the positions of the axle 30 during said back-and-forth movement. In a first position, illustrated in FIG. 2*a*, the axle 30 is not rotated by the motor 12. A first movement of the motor 12, illustrated in FIG. 2*b*, drives the axle 30 about itself and consequently the evaporation and condensing chambers in a first direction of rotation with an angular displacement $\alpha 1$ of less than 180°.

Figure 2C:
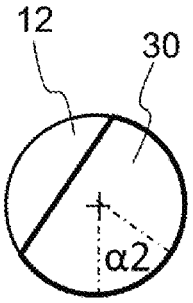

A second movement of the motor 12, illustrated in FIG. 2*c*, drives the axle 30 about itself and consequently the evaporation and condensing chambers in a second direction of rotation, opposite to the first direction of rotation, with an angular displacement $\alpha 2$ substantially equal to the angular displacement of the first movement. The back-and-forth movement thus corresponds to an oscillation of the axle 30, i.e. a rotation of the axle 30 about itself in one direction then in the other. The axle 30 therefore does not make a complete rotation, thus limiting the risk of winding the flexible connectors connecting the external devices to the chambers 5, 10. On the contrary, the flexible connectors are configured to be deformed and absorb the displacements of the chambers 5, 10 during rotations so as to maintain a sealed and sterile connection.

The rotational movements thus make it possible to avoid the clumping of products in the evaporation chamber 5 during freeze-drying while limiting the time of the freeze-drying process. Advantageously, the evaporation chamber 5 also includes baffles disposed inside the evaporation chamber 5.

The baffles extend radially towards the interior of the evaporation chamber 5 and enable the mixing of the products during freeze-drying to be improved. For example, Palamatic® plowshare mixers can be used.

The axle 30 can be mounted horizontally relative to the cylindrical body of the chambers 5, 10. In this embodiment, the device advantageously includes means of pivoting the axle in the vertical plane allowing the products disposed in the evaporation chamber 5 to be guided towards the outlet 8 when the freeze-drying is completed.

As a variant, the axle 30 can be mounted with a bias, i.e. tilted in the vertical plane so as to guide the products towards the outlet 8 during the freeze-drying process. In this embodiment, the outlet 8 is lower than the inlet 1 so as to use gravity to move the freeze-dried products towards the outlet 8.

Moreover, because the freeze-drying process is particularly dependent on the differences in temperature and pressure, the chambers 5, 10 are preferably equipped with instruments such as temperature sensors 20, 24 and pressure sensor 21.

Two sensors 20, 21 are disposed in the evaporation chamber 5 to monitor the temperature and pressure in the evaporation chamber 5. A third sensor 24 is disposed in the condensing chamber 10 to monitor the temperature of the condensing chamber 10. An operator can then follow the freeze-drying process by means of the sensors 20, 21, 24 and estimate the quantity of water eliminated from the products over time. Thus, it is possible to determine the exact moment for which a desired concentration of water is reached in order to stop the freeze-drying.

To carry out freeze-drying by means of the previously described device, an operator opens the lock 2, while the lock 4, the valve 7 and the lock 9 are closed. Products to be freeze-dried are thus added into the evaporation chamber 5, for example previously frozen products. The lock 2 is then closed and the valve of the airlock 4 is opened to place the two chambers 5, 10 in communication.

A vacuum is then produced by opening the valve 7 and actuating the vacuum pump 6. When the vacuum is created, the vacuum is essentially maintained by the condensation of the vapor on the ice 11. The next step consists of carrying out the sublimation of the water contained in the frozen products. To do this, the frozen products are heated by actuating the heating means 15, 16 of the evaporation chamber 5 and actuating cooling means 17, 18 of the condensing chamber 10. For example, the temperature of the products in the evaporation chamber 5 is shifted from −30° C. to −25° C. under a vacuum of 6.1 hPa.

The water from the frozen products is then sublimated and penetrates into the condensing chamber 10 in vapor form where it is frozen and trapped in the condensing chamber 10 by the ice trap 11 the temperature whereof is preferably between −50° C. and −60° C. For example, the screen or membrane, preferably made of Gore-Tex®, at the airlock 4 can prevent the dispersal of product particles if the evaporation speed is high.

During this time, the motor 12 rotates the axle 30 about itself in the two movements previously described. Said movements are repeated alternately throughout the time of sublimation. For example, the motor can be a brushless electric motor. Preferably, the motor is an electric motor having a plurality of operating positions for which the magnetic field of the stator corresponds to an angular position of the rotor. Instead of moving the magnetic field of the stator circularly to drive the electric motor in a circular movement, the invention proposes to use the motor to perform a "back-and-forth" movement. For example, an electric motor that has four pairs of poles is conventionally rotated by successively supplying the consecutive pairs of poles: the first pole pair, the second pole pair, the third pole pair, the fourth pole pair, the first pole pair, etc. The "back-and-forth" movement can be generated by supplying the first pole pair, then the second pole pair, then the first pole pair, then the fourth pole pair, then the first pole pair, then the second pole pair, etc.

To reduce the weight born by the rotor of the motor, the evaporation 5 and condensing 10 chambers can be mounted on wheels movable in the direction of rotation and configured to support the weight of the chambers.

When the duration of freeze-drying is reached to obtain the desired concentration of water, the valve of the airlock 4 is closed and the heating means 15, 16 and cooling means 17, 18 are stopped. The lock 9 is opened and the freeze-dried products are extracted from the evaporation chamber 5 through the outlet 8. To extract the trapped ice in the condensing chamber 10 and sterilize the entire facility, steam is added to the condensing chamber 10 through the steam injection nozzles 31, 32 in order to melt the ice and sterilize the two chambers 5, 10. The steam thus contained in the two chambers 5, 10 is extracted through the drain 33 or through the outlet 8 when the product is extracted from the condensing chamber 10. To finish, the lock 9 is reclosed, the two chambers 5, 10 are cooled by means of the connectors 15-18 and a new freeze-drying can be performed.

Figure 3:
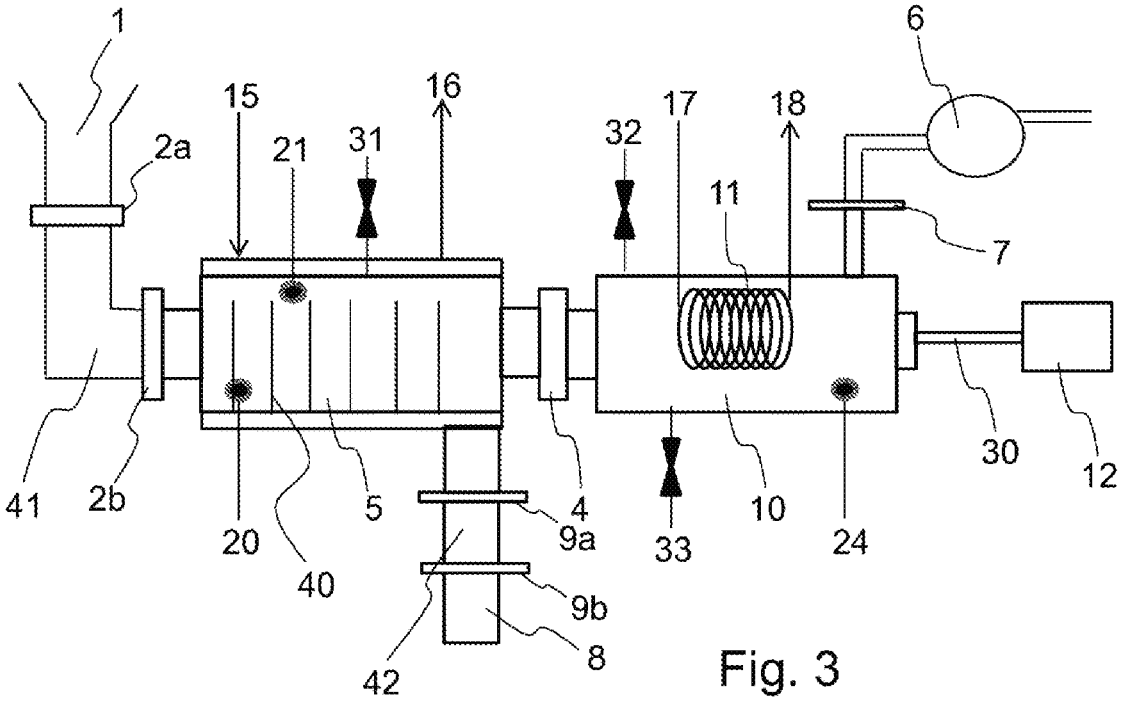
FIG. 3 is a schematic structural representation of a freeze-drying device according to a second embodiment of the invention.

FIG. 3 illustrates a second embodiment wherein the evaporation chamber 5 includes partitions 40 extending over only a portion of the height of the evaporation chamber 5 forming compartments between said partitions 40.

Preferably, because the evaporation chamber 5 is cylindrical, the partitions 40 extend radially relative to the evaporation chamber 5. The top of each partition 40 is provided with an opening 39 intended to allow the passage of products between two consecutive compartments. FIG. 4 shows a sample implementation of these partitions by the presence of an opening at the upper part of the partition 40.

The device further comprises an inlet 1 connected to the evaporation chamber 5 by a loading chamber 41 so as to add products to be freeze-dried. To do this, the loading chamber 41 is partitioned by two locks 2*a*, 2*b*. Products are added to the loading chamber 41 from the inlet 1 when the first lock 2*a* is opened. The first lock 2*a* is then closed and the second lock 2*b* is opened so as to add the products into the evaporation chamber 5. The outlet 8 is also connected to the evaporation chamber 5 by means of an unloading chamber 42 also partitioned between two locks 9*a*, 9*b*.

In this variant, the motor 12 induces at least three rotational movements of the axle 30 about itself, two of which movements are limited in amplitude so as to create a back-and-forth movement. In a first position, illustrated in FIG. 4*a*, the axle 30 is not rotated by the motor 12, the evaporation chamber 5 is upright. The opening 39 of the partition 40 is positioned on the upper part of the evaporation chamber 5 and the products are contained in the compartment delimited by the partition 40.

Figure 4A:
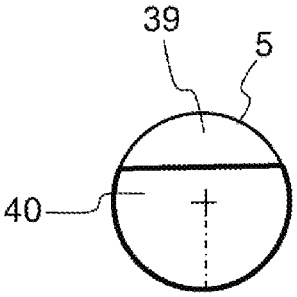
FIGS. 4*a* to 4*d* are sectional views of the position of a partition relative to the evaporation chamber in four different positions of the freeze-drying device of FIG. 3.
Figure 4B:
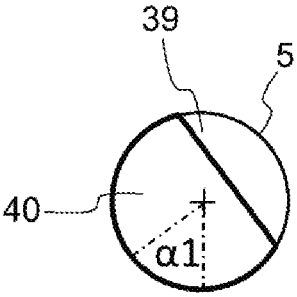

A first movement of the motor 12, illustrated in FIG. 4*b*, drives the axle 30 about itself and in a first direction of rotation with an angular displacement $\alpha 1$ between 5° and 90°. Said low amplitude rotation does not allow the products disposed in the compartment to migrate towards the adjacent compartments because the height of the partition 40 is sufficient to contain the products.

Figure 4C:
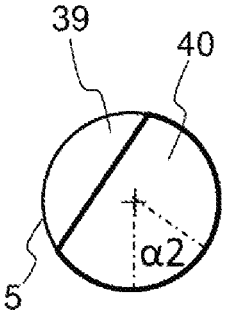

A second movement of the motor 12, illustrated in FIG. 4*c*, drives the axle 30 about itself in a second direction of rotation, opposite to the first direction of rotation, with an angular displacement $\alpha 2$ substantially equal to the angular displacement of the first movement.

Said low amplitude rotation does not allow the products disposed in the compartment to migrate towards the adjacent compartments because the height of the partition 40 is sufficient to contain the products. The back-and-forth movement thus corresponds to an oscillation of the axle 30, i.e. a rotation of the axle 30 about itself in one direction then in the other.

Figure 4D:
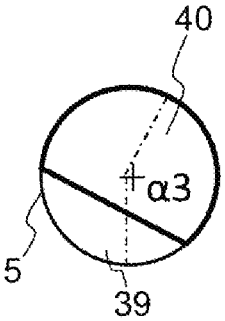

A third movement of the motor 12, illustrated in FIG. 4*d*, drives the axle 30 about itself with an angle of rotation $\alpha 3$ between 90° and 180°. This large amplitude motion is to allow the displacement of the products between two consecutive compartments because the opening 39 of the partition 40 is disposed downwards.

The axle 30 can be disposed horizontally relative to the cylindrical body of the chambers 5, 10. In this embodiment, the device advantageously comprises means of pivoting the axle in the vertical plane in order to guide the products disposed in the evaporation chamber 5 between two consecutive compartments during the third movement. As a variant, the axle 30 can be mounted with a bias, i.e. inclined in the vertical plane, so as to guide the products against the partition 40 during the back-and-forth movement and between two consecutive compartments during the large amplitude movement.

Preferably, the partitions 40 are produced from metal so as to conduct heat to the center of the evaporation chamber 5. Moreover, because the freeze-drying process is particularly dependent on temperature and pressure differences, the chambers 5, 10 are preferably equipped with instruments such as temperature 20, 24 and pressure 21 sensors.

To carry out freeze-drying by means of the device previously described, an operator or a programmable logic controller opens the lock 2*a* and the compartment between the locks 2*a* and 2*b* is placed under a vacuum. When the vacuum is achieved, the lock 2*b* is opened and products to be freeze-dried are thus added to the first compartment of the evaporation chamber 5, for example products that were previously frozen. The lock 2*b* is then closed and the lock 2*a* is opened once the vacuum is established in the lock, so as to again add products into the loading chamber 41.

The vacuum is initially produced by opening the valve 7 and actuating the vacuum pump 6. When the vacuum is created, the valve 7 remains open and the vacuum pump 6 continues to operate but the vacuum is essentially ensured by condensation of the vapor onto the trap 11.

The next step consists of carrying out the sublimation of the water from the frozen products.

To do this, the frozen products are heated by actuating the heating means 15, 16 of the evaporation chamber 5 and actuating cooling means 17, 18 of the condensing chamber 10.

For example, the temperature of the products in the evaporation chamber 5 is shifted from −30° C. to −25° C. under a vacuum of 6.1 hPa. The water from the frozen products is then sublimated and enters the condensing chamber 10 in vapor form where it is frozen and trapped in the condensing chamber 10 by the ice trap 11 the temperature whereof is preferably between −50° C. and −60° C. For example, the screen at the airlock 4 can prevent the dispersal of product particles if the evaporation speed is high.

During this time, the motor 12 rotates the axle 30 in the three movements previously described. The two back-and-forth movements are repeated alternately during a first cycle. When the holding time of the products in the first compartment is reached, the motor 12 rotates the axle 30 in a third large-amplitude movement so as to move the products from the first compartment towards the second compartment. When the products have been transferred to the second compartment, the lock 2*b* is opened and new products are added to the first compartment according to the process previously described.

When the freeze-drying time is reached to obtain the desired concentration of water and the first product has been moved between all of the compartments, the compartment between the locks 9*a* and 9*b* is under vacuum, the lock 9*a* is opened and the freeze-dried products are extracted from the evaporation chamber 5 through the unloading chamber 42. The lock 9*a* is then reclosed and the lock 9*b* is opened to extract the product through the outlet 8. In the same way as for the intake, the products are added to the lock under vacuum, then once the lock 9*a* is closed, the vacuum is broken and sterile nitrogen is used to return to atmospheric pressure before opening the lock 9*b*. Once the chamber 42 is emptied, the lock 9*b* is closed and a vacuum is reestablished in the chamber 42 while waiting for the next load.

When all of the products have been freeze-dried, the valve of the airlock 4 is closed and the heating 15, 16 and cooling means 17, 18 are stopped. To extract the trapped ice in the condensing chamber 10, steam is added to the condensing chamber 10 through the steam injection nozzles 31, 32 in order to melt the ice and sterilize the two chambers 5, 10.

The steam thus contained in the two chambers 5, 10 is extracted through the drain 33. To finish, the lock 9 is closed again and a new freeze-drying load can be carried out.

Figure 5:
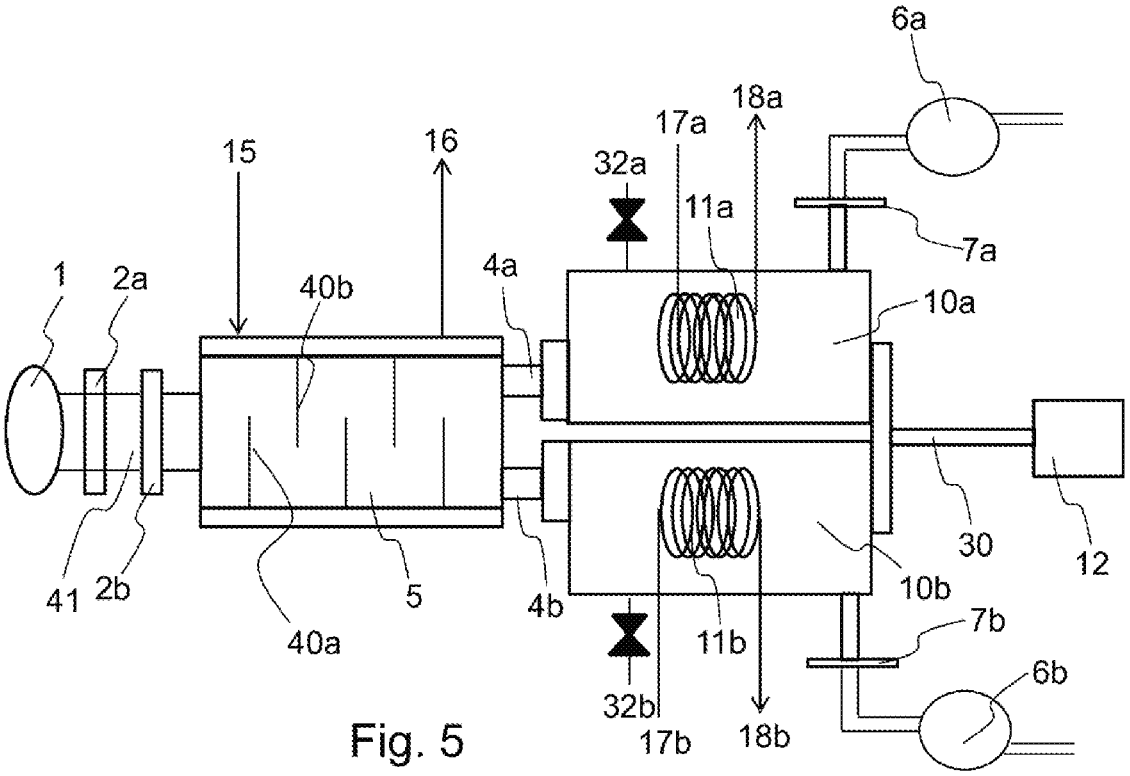
FIG. 5 is a schematic structural representation of a freeze-drying device according to a third embodiment of the invention.

FIG. 5 illustrates a third embodiment of the invention wherein two condensing chambers 10*a*, 10*b* are connected to the evaporation chamber 5 by two different airlocks 4*a*, 4*b*.

The two condensing chambers 10*a*, 10*b* are substantially identical and each has an ice trap 11*a*, 11*b* supplied by cooling means 17*a*, 17*b*, 18*a*, 18*b* as described with the first embodiment of the invention. The utilization of two condensing chambers 10*a*, 10*b* makes it possible to regenerate one of the chambers while the other is functioning so as to extract the ice stored in water form. To do this, the first chamber 10*a* is connected to the chamber 5 by opening the airlock 4*a* while the second chamber 10*b* is not connected to the chamber 5 by closure of the airlock 4*b*. Water in ice form is trapped in the first chamber 10*a* during the freeze-drying process.

When the ice trap 11*a* of the first chamber 10*a* is substantially full, the airlock 4*b* is opened, then the airlock 4*a* is closed so as to use the second chamber 10*b* to trap the water vapor. During use of the second chamber 10*b*, the first chamber 10*a* is depressurized, then steam is injected by the nozzle 32*a* so as to evacuate the water trapped in ice form. The first chamber 10*a* can then be reused when the ice trap 11*b* of the second chamber 10*b* is substantially full.

Preferably, when the freeze-drying is carried out under vacuum, each recovery chamber 10*a*, 10*b* is connected to a vacuum pump 6*a*, 6*b* by means of a valve 7*a*, 7*b*. Thus, before opening the airlock 4*a*, 4*b* connecting a recovery chamber 10*a*, 10*b* to the evaporation chamber 5, the recovery chamber 10*a*, 10*b* is placed under vacuum.

Furthermore, during regeneration of the ice trap 11*a*, 11*b*, the valve 7*a*, 7*b* is opened without actuating the respective vacuum pump 6*a*, 6*b* so as to depressurize the condensing chamber 10*a*, 10*b*. The injection of steam during regeneration of the condensing chamber 10*a*, 10*b* also makes it possible to sterilize said condensing chamber 10*a*, 10*b*.

Moreover, as illustrated in FIG. 6, the partitions 40*a*, 40*b* have two different shapes mounted alternately in the evaporation chamber 5. Preferably, because the evaporation chamber 5 is cylindrical, the partitions 40*a*, 40*b* extend radially relative to the evaporation chamber 5.

Figures 6A, 6B, 6C, 6D, 6E:
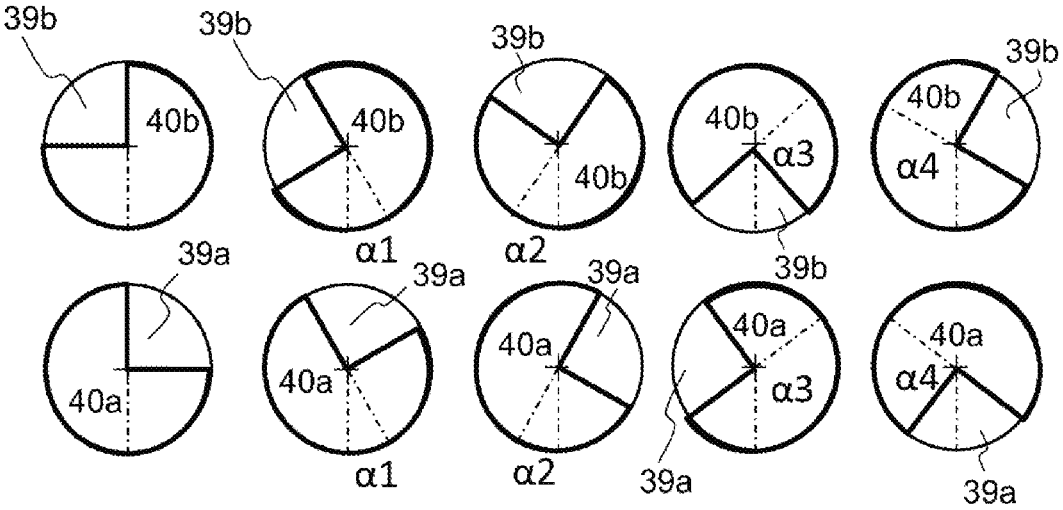
FIGS. 6*a* to 6*e* are sectional views of the position of two consecutive partitions relative to the evaporation chamber in five different positions of the freeze-drying device of FIG. 5.

Each partition 40*a*, 40*b* is disc-shaped, one portion of which—forming substantially one fourth of the disc—is removed in such a way as to form an opening 39*a*, 39*b*. Each opening 39*a*, 39*b* is intended to allow the passage of products between two consecutive compartments. The openings 39*a*, 39*b* of two consecutive partitions 40*a*, 40*b* are axially offset relative to the axis of revolution of the cylinder forming the evaporation chamber 5, as illustrated in FIG. 6*a* when the motor 12 is not rotating the evaporation chamber 5. The axial offset between the two openings 39*a*, 39*b* of two consecutive partitions 40*a*, 40*b* is substantially 90°.

In the same way as for the second embodiment, when the motor 12 imparts a back-and-forth movement of low amplitude, as illustrated in FIGS. 6*b* and 6*c*, the openings 39*a*, 39*b* of two partitions 40*a*, 40*b* are not positioned at the bottom of the evaporation chamber 5 and the products are contained in their respective compartments.

A first large amplitude movement, illustrated in FIG. 6*d* induces an axial offset $\alpha 3$ of between 90° and 180° towards the right. The first opening 39*a* of the first partition 40*a* is disposed on the left side while the second opening 39*b* of the second partition 40*b* is disposed at the lower part of the evaporation chamber 5. The result is that the second partition 40*b* allows the passage of the product while the first partition 40*a* retains the products.

A second large amplitude movement, illustrated in FIG. 6*e*, induces an axial offset $\alpha 4$ of between 90° and 180° towards the left. The first opening 39*a* of the first partition 40*a* is disposed at the lower part of the evaporation chamber 5 while the second opening 39*b* of the second partition 40*b* is disposed at the left side. The result is that the first partition 40*a* allows the passage of the product while the second partition 40*a* retains the products.

These two large amplitude movements make it possible to manage the displacement of products between the compartments.

Preferably, a large amplitude movement is synchronized with the opening of the locks 2*b* and 9*a* is intended to allow adding and extracting products from the evaporation chamber 5.

The invention thus makes it possible to freeze-dry products disposed in bulk in the evaporation chamber 5, and continuously, i.e. without stopping the heating means 15, 16 and cooling means 17, 18 between two products to be freeze-dried.

The energy consumption of the freeze-drying device of the invention is 20 to 40% lower than devices of the prior art for the same quantity of products.

Furthermore, it is now possible to run faster cycles thanks to the improvement in heat transfers and materials, and with better control over the freeze-drying process by means of temperature sensors. Because the product is mixed, it is more homogeneous and the information collected by the sensors 20, 21, 24 enables better characterization of the product.

The number of compartments is not limited. It makes it possible to establish the product output frequency. Since one of every two compartments is used so as not to have mixing in two consecutive compartments, the output frequency of the product is calculated in this way: if the holding time of the product is 10 hours, with 20 compartments one product load can be discharged every hour. With 40 compartments and a holding time of 10 hours, the discharge frequency can be reduced to every half-hour.

The output frequency from the evaporator becomes a variable that depends on the number of compartments and the overall holding time in the evaporation chamber 5. The holding time of the product in the freeze dryer can also depend on other factors such as the size of the pellets or granules introduced, and the frequency of the agitation movement.

The invention also makes it possible to freeze-dry products in a way that is automated and sterile because the operator has no physical connection to make at the inlet 1 and outlet 8 of the evaporation chamber 5. Moreover, the heating conditions between two successive compartments can be modified in order to improve the freeze-drying process.

The invention has been implemented efficiently with one evaporation chamber 5 having a capacity between 0.01 and 1 $m^3$. As a variant, freeze-drying can be done without placing the chambers 5, 10 under a vacuum by using the zeodration technique. In this way the vacuum pump 6 and the valve 7 can be eliminated. As a variant, the freeze-drying device can extract solvents other than water, for example alcohol.

The invention claimed is:

1. Freeze-drying device comprising:

an evaporation chamber (5) comprising means (15, 16) of heating said evaporation chamber (5) that are configured to sublimate the water contained in the frozen products intended to be placed in the evaporation chamber (5), a condensing chamber (10) communicating with said evaporation chamber, and comprising means (17, 18) of cooling said condensing chamber (10) that are configured to transform the vapor coming from said evaporation chamber (5) into ice, said evaporation chamber (5) and said condensing chamber (10) being mounted secured to one another about a rotatable axle (30), characterized in that the device further comprises:

a products inlet and outlet (1, 8) connected to the evaporation chamber (5) by flexible connectors, the products inlet and outlet (1, 8) being mounted fixedly with respect to the evaporation chamber, and a motor (12) driving said axle (30) about itself with the following back-and-forth movement:

a first movement driving said axle (30) in a first direction of rotation with an angle of rotation ($\alpha$1) between 5° and 90°; and a second movement driving said axle (30) in a second direction of rotation, opposite to the first angle of rotation, with an angle of rotation ($\alpha$2) between −5° and −90°.

2. The freeze-drying device according to claim 1, characterized in that said evaporation chamber (5) comprises compartments formed by partitions (40) extending over only a portion of the height of said evaporation chamber (5) said motor (12) driving said axle (30) about itself according to a third movement with an angle of rotation of between 90° and 180°, said third movement being coupled to an inclined position of said evaporation chamber (5) so as to move the products by gravity between two consecutive compartments.

3. The freeze-drying device according to claim 2, characterized in that said inlet (1) comprises a loading chamber (41) partitioned by two locks (2*a* 2*b*), and in that said outlet (8) comprises an unloading chamber (42) partitioned by two locks (9*a*, 9*b*).

4. The freeze-drying device according to claim 3, characterized in that the opening of said lock (2*b*) separating said inlet (1) from said evaporation chamber (5) and the opening of said lock (9*a*) separating said outlet (8) from said evaporation chamber (5) are synchronized with said third movement of said motor (12).

5. The freeze-drying device according to claim 2, characterized in that it comprises two condensing chambers (10*a*, 10*b*) connected to said evaporation chamber (5) by two different airlocks (4*a*, 4*b*), a first condensing chamber (10*a*) being connected to said evaporation chamber (5) by opening the first airlock (4*a*) and closing the second airlock (4*b*) so as to use said first condensing chamber (10*a*) to trap vapor coming from said evaporation chamber (5), a second condensing chamber (10*b*) then being regenerated during use of said first condensing chamber (10*a*) and vice versa.

6. The freeze-drying device according to claim 5, characterized in that it comprises two vacuum pumps (6*a*, 6*b*), a first vacuum pump (6*a*) connected to said first condensing chamber (10*a*) and a second vacuum pump (6*b*) connected to said second condensing chamber (10*b*).

7. The freeze-drying device according to claim 2, characterized in that said evaporation chamber (5) is inclined between said inlet (1) and said outlet (8).

8. The freeze-drying device according to claim 2, characterized in that the partitions (40) of said evaporation chamber (5) have two different shapes mounted alternately in the evaporation chamber (5), the two shapes having axially offset openings (39) intended for the passage between two compartments of the product to be freeze-dried.

9. The freeze-drying device according to claim 2, characterized in that said motor (12) is configured to drive said axle (30) according to a fourth movement complementary with said three movements, said fourth movement driving said axle (30) in a direction opposite to the direction of the third movement with an angle of rotation ($\alpha$4) of between −90° and −180° so as to move the products between two consecutive compartments of said evaporation chamber (5).

10. The freeze-drying device according to claim 1, characterized in that the evaporation chamber is disposed laterally relative to the condensing chamber(s).

11. The freeze-drying device according to claim 1, characterized in that said evaporation chamber (5) includes a double outer wall, said heating means (15, 16) being configured to move a heat transfer fluid in a space formed between the two walls of said evaporation chamber (5).

12. The freeze-drying device according to claim 1, characterized in that said flexible connectors have a plurality of stainless steel coils.

13. A freeze-drying method implemented by a device according to claim 1, the method comprising the steps of:

filling said evaporation chamber (5) with products, frozen or not, by opening said products inlet (1), when the products are not frozen, cooling the evaporation chamber by the cooling means until the products are frozen, once the products are frozen, placing the evaporation chamber (5) and the condensing chamber (10) under a vacuum, heating said evaporation chamber (5) by said heating means (15, 16) until obtaining sublimation of the water contained in the frozen products contained in said evaporation chamber (5), cooling said condensing chamber (10) by cooling means (17, 18) so as to trap the vapor entering into said condensing chamber (10), agitation of said evaporation chamber (5) and of said condensing chamber (10) by rotation of said axle (30) about itself in two repeated complementary movements throughout the sublimation time:

a first movement driving said axle (30) in a first direction of rotation with an angle of rotation ($\alpha$1) of less than 180°; and a second movement driving said axle (30) in a second direction, opposite to the first direction of rotation, with an angle of rotation ($\alpha$2) of less than −180°, and extraction of the products from said evaporation chamber (5).

14. The freeze-drying method implemented by a device according to claim 2, the method comprising the steps of:

filling the evaporation chamber with products, frozen or not, by opening the products inlet, when the products are not frozen, cooling the evaporation chamber until the products are frozen, placing the evaporation chamber (5) and the condensing chamber (10) under a vacuum, heating said evaporation chamber (5) by said heating means (15, 16, 31) until obtaining sublimation of the water contained in the frozen products contained in said compartments of said evaporation chamber (5), cooling said condensing chamber (10) by said cooling means (17, 18) so as to solidify the vapor entering into said condensing chamber (10), agitation of said evaporation chamber (5) by rotation of said axle (30) about itself in two repeated complementary movements throughout the length of stay in each compartment;

a first movement driving said axle (30) in a first direction of rotation with an angle of rotation ($\alpha$1) between 5° and 90°, a second movement driving said axle (30) in a second direction, opposite to the first direction of rotation, with an angle of rotation ($\alpha$2) of between 5° and 90°, displacement of the products between two consecutive compartments by displacement of said axel (30) according to a third movement with an angle of rotation ($\alpha$3) of between 90° and 180°, said third movement being coupled to an inclined position of the evaporation chamber (5), and extraction of the products from said evaporation chamber (5).

* * * * *